US006411021B1

(12) United States Patent
Izawa et al.

(10) Patent No.: US 6,411,021 B1
(45) Date of Patent: Jun. 25, 2002

(54) WEDGE BASE BULB WITH COLOR COATING

(75) Inventors: Takeshi Izawa; Koichi Nakamura, both of Shizuoka (JP)

(73) Assignee: Koito Manufacturing Co., LTD, Tokyo (JP)

( * ) Notice: Subject to any disclaimer, the term of this patent is extended or adjusted under 35 U.S.C. 154(b) by 0 days.

(21) Appl. No.: 09/060,816

(22) Filed: Apr. 16, 1998

(30) Foreign Application Priority Data

Apr. 18, 1997 (JP) ..... 9-101504

(51) Int. Cl.[7] ..... H01J 5/16

(52) U.S. Cl. ..... 313/315; 313/112; 313/318.09; 313/318.1; 313/578

(58) Field of Search ..... 313/567, 568, 313/569, 634, 635, 284, 285, 318.05, 318.07, 318.09, 318.1, 314, 315, 316, 110, 112, 117, 578–580; 362/311; 427/106, 107, 58, 105

(56) References Cited

U.S. PATENT DOCUMENTS

| | | | | | |
|---|---|---|---|---|---|
| 3,946,263 | A | * | 3/1976 | Protzeller | 313/312 |
| 4,079,283 | A | | 3/1978 | George | |
| 4,197,333 | A | * | 4/1980 | Leach et al. | 427/54.1 |
| 4,366,407 | A | * | 12/1982 | Walsh | 313/112 |
| 4,535,269 | A | * | 8/1985 | Tschetter et al. | 313/579 |
| 4,658,180 | A | | 4/1987 | Ooms | |
| 4,683,397 | A | * | 7/1987 | Joihnson, Jr. | 313/344 |
| 4,728,847 | A | | 3/1988 | Ooms et al. | |
| 4,883,434 | A | * | 11/1989 | Toyoshima | 439/619 |
| 4,937,714 | A | * | 6/1990 | Witt | 362/255 |
| 4,957,455 | A | | 9/1990 | Horiuchi et al. | |
| 5,006,088 | A | | 4/1991 | Tokuhara et al. | |
| 5,008,588 | A | * | 4/1991 | Nakahara | 313/318 |
| 5,093,601 | A | * | 3/1992 | Watanabe et al. | 313/25 |
| 5,142,197 | A | * | 8/1992 | Kawakatsu | 313/635 |
| 5,221,140 | A | * | 6/1993 | Oshino | 362/255 |
| 5,578,893 | A | | 11/1996 | Yamamoto | |
| 5,634,823 | A | * | 6/1997 | Furuta et al. | 439/699.2 |
| 5,719,468 | A | * | 2/1998 | Takanishi et al. | 313/578 |

FOREIGN PATENT DOCUMENTS

| | | |
|---|---|---|
| EP | 0446461 | 9/1991 |
| GB | 246985 | 2/1926 |
| GB | 2251122 | 6/1992 |

* cited by examiner

*Primary Examiner*—Michael H. Day
*Assistant Examiner*—Joseph Williams
(74) *Attorney, Agent, or Firm*—Sughrue Mion, PLLC

(57) ABSTRACT

To eliminate the need for a cap provided only for coloring the light of a wedge-base bulb, and to eliminate the requirement for a multi-colored front lens of a vehicle identification lamp, a colored coating is formed on the surface of a glass bulb of a wedge-base bulb. The bulb is dipped in a color coating and a rib and/or groove is provided between the bulb and a base portion of the wedge-base bulb to prevent the coating from adhering to the base portion where terminals are disposed.

12 Claims, 6 Drawing Sheets

WEDGE BASE BULB WITH COLOR COATING

BACKGROUND OF THE INVENTION

1. Field of the Invention

The present invention relates to a new wedge-base bulb in which light emitted to the outside is colored by a colored coating on the glass bulb, as well as a method for applying the colored coating to the glass bulb.

2. Background Art

There is a bulb called a wedge-base bulb in which a filament and a lead supporting the filament are disposed in a glass bulb, and a portion of the lead is led out to the outside from a base portion formed at one end portion of the glass bulb, so that the led-out portion of the lead forms a current-conducting terminal.

Such a wedge-base bulb is mainly used as a light source of an automotive identification lamp, such as a turn signal lamp, a brake lamp, etc. Although the light emitted from a wedge-base bulb is nearly colorless, orange (amber) light is required for the turn signal lamp, and red light is required for the brake lamp.

Therefore, conventionally, a front lens covering the front side of the identification lamp is formed of a transparent member which is colored orange or red. Alternatively, a so-called cap, which is transparent and colored orange or red, is put on the wedge-base bulb to cover its circumference, so that light having a desired color is emitted to the outside.

In the case of using a cap for obtaining light having a desired color, the cap is required in addition to the regular parts that constitute the automotive identification lamp. Accordingly, this increases the number of parts and therefore the manufacturing cost of the automotive identification lamp.

On the other hand, a front lens for covering the front side of the identification lamp is formed of a transparent. member and colored orange or red, as in the case of a so-called rear combination lamp typically used at a rear portion of a car. In a rear combination lamp, a turn signal lamp, a brake lamp, a tail lamp and a back lamp are provided integrally. The front lens covering the entire front side of the rear combination lamp must be a multi-color member colored in orange, red or other colors. Accordingly, this increases the manufacturing cost, and otherwise limits the design of the rear combination lamp and the vehicle.

SUMMARY OF THE INVENTION

Taking the foregoing problems into consideration, it is an object of the present invention to provide a wedge-base bulb in which it is possible to eliminate the need for a cap for coloring the light emitted from the wedge-base bulb, or a colored front lens of an automotive identification lamp.

In order to solve the foregoing problems, in a wedge-base bulb according to the present invention, a colored coating is formed on the surface of the glass bulb. When the colored coating is formed, excess colored coating material drips away from the base portion and terminals due to the presence of grooves and/or ribs between the glass bulb and a base portion of the wedge-base bulb.

Consequently, it is not necessary to use a cap or a colored front lens for coloring the light emitted from the wedge-base bulb in a desired color.

BRIEF DESCRIPTION OF THE DRAWING FIGURES

Figure 4A:
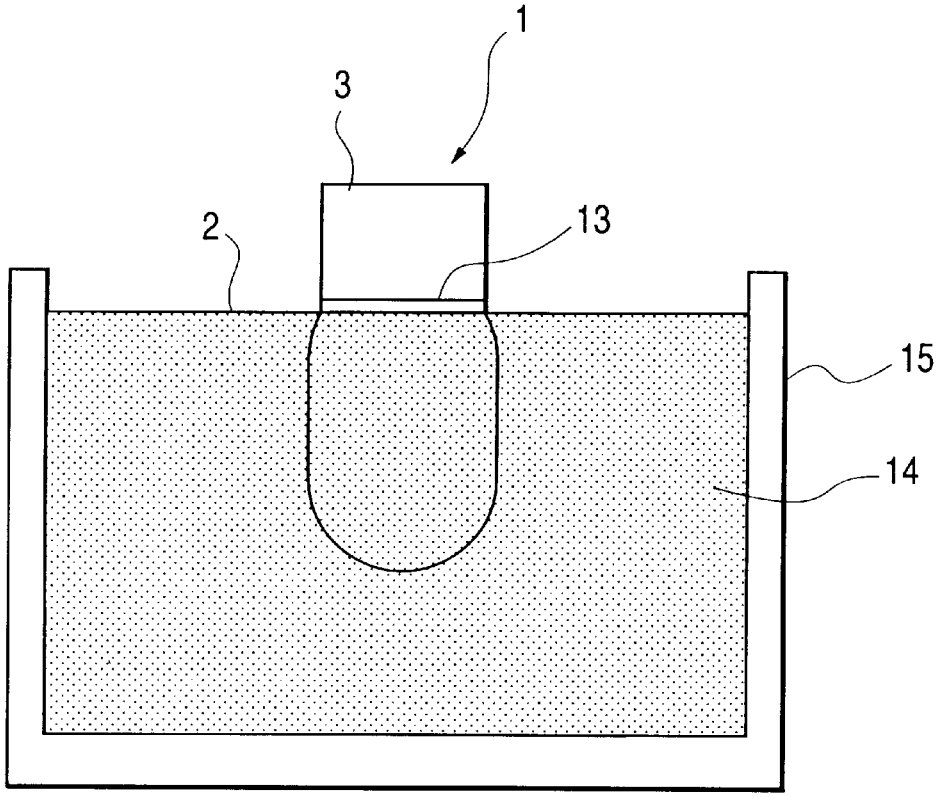
Figure 4B:
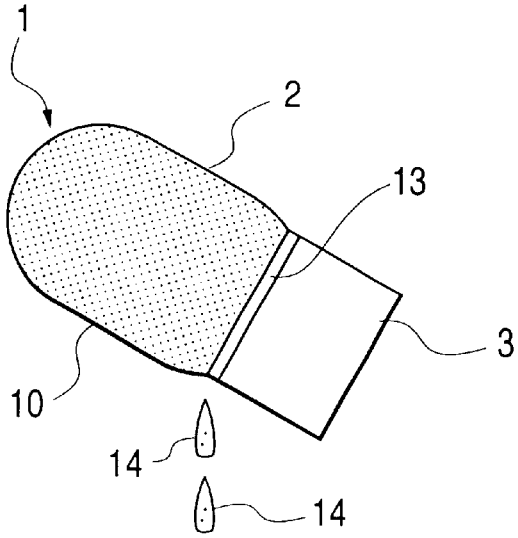

FIGS. 4(*a*) and 4(*b*) schematically show a coating process for applying a coating onto a portion of a glass bulb.

Figure 5:
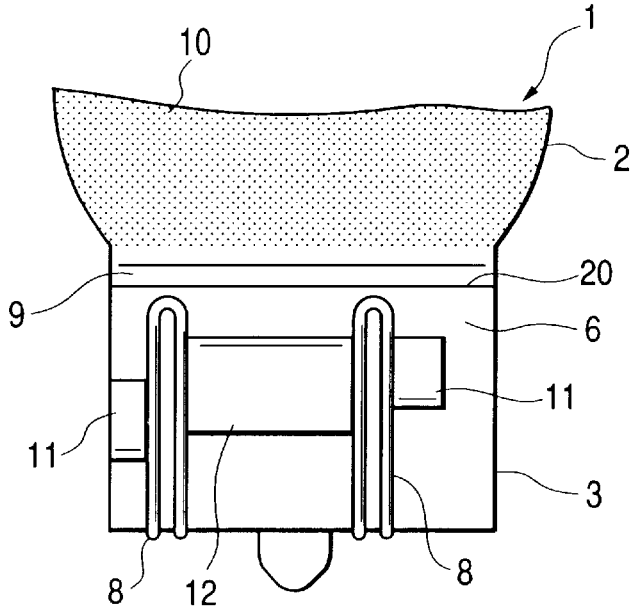
Figure 6:
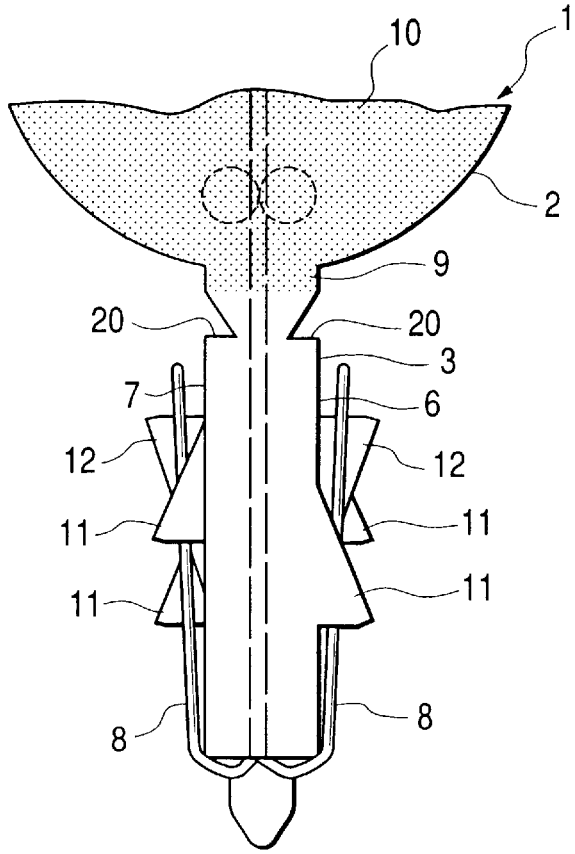

FIG. 5 is a front view of a base portion, showing, together with FIG. 6, a first modification of a wedge-base bulb according to the present invention.

FIG. 6 is a side view of the base portion of the bulb.

Figure 7:
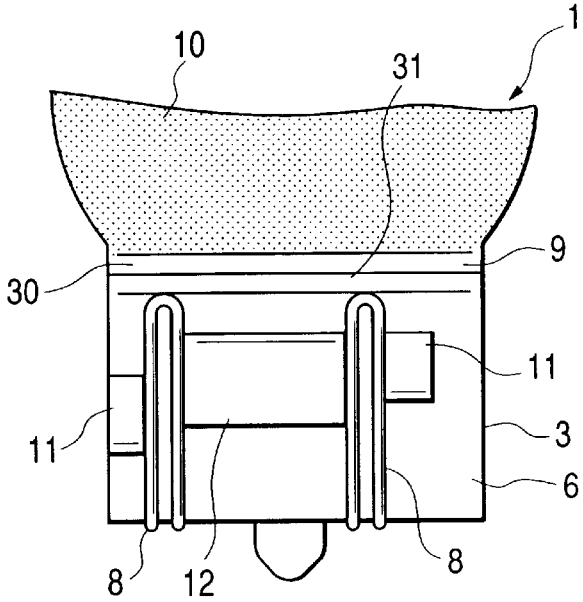
Figure 8:
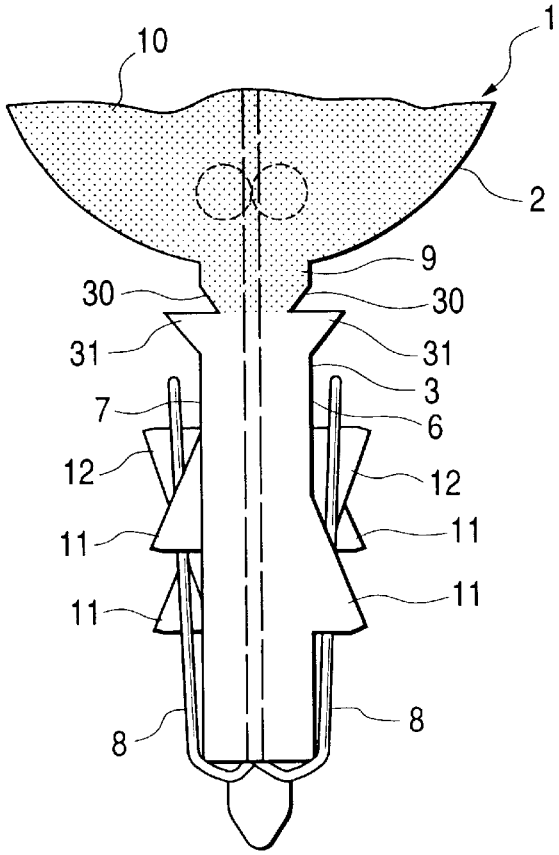

FIG. 7 is a front view of a base portion, showing, together with FIG. 8, a second modification of a wedge-base bulb according to the present invention.

FIG. 8 is a side view of the base portion of the bulb.

Figure 9:
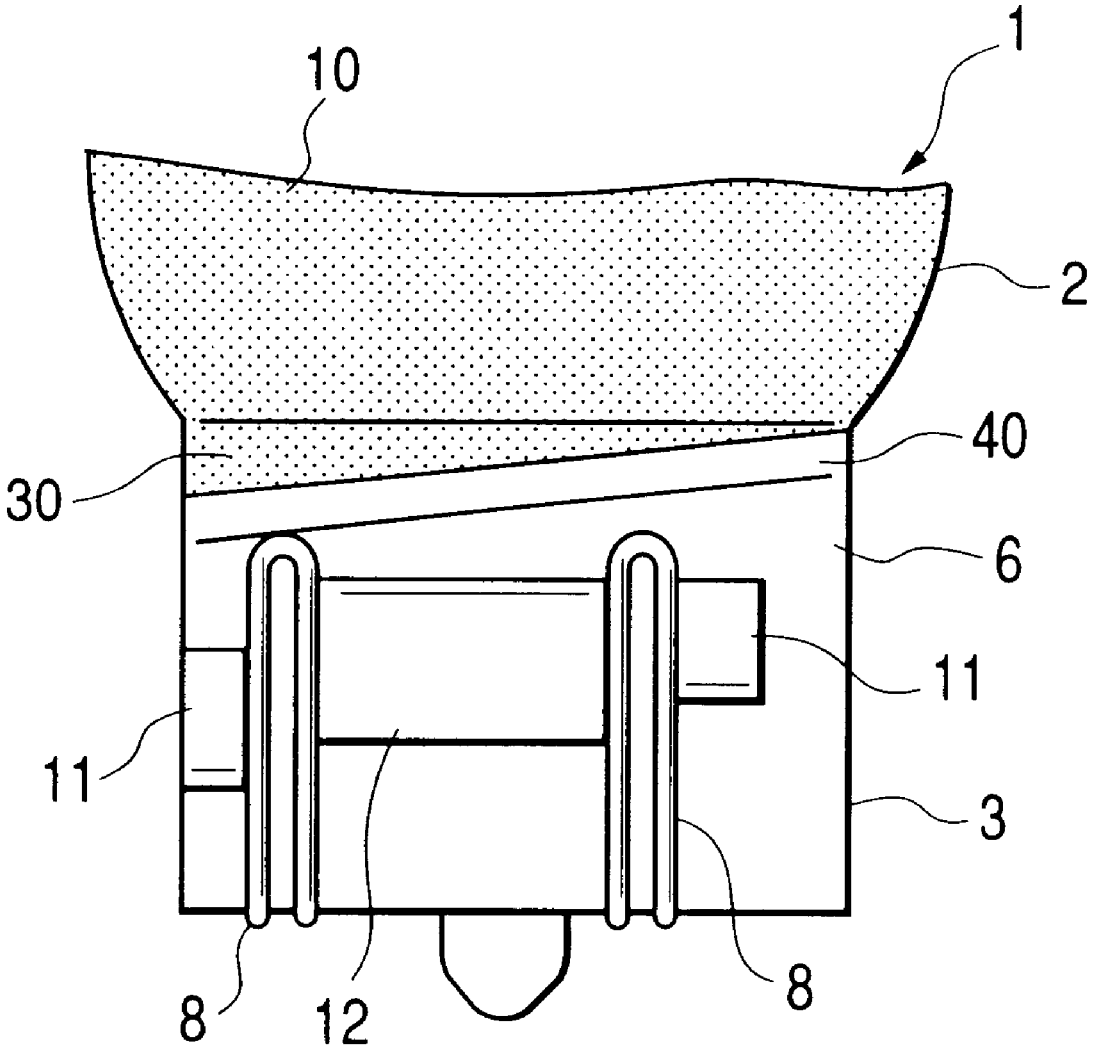

FIG. 9 is a front view of a base portion, showing a third modification of a wedge-base bulb according to the present invention.

DETAILED DESCRIPTION OF PREFERRED EMBODIMENTS

A wedge-base bulb and method of coating the glass bulb of the wedge-base bulb according to the present invention will be described below with reference to the accompanying drawings.

Wedge-base bulbs can be classified into a so-called single-filament type wedge-base bulb and a so-called double-filament type wedge-base bulb in accordance with the number of filaments of the wedge-base bulbs. In the following embodiments, the wedge-base bulb is of the double-filament type and for use particularly in a turn signal lamp, although the invention is not so limited.

A wedge-base bulb (hereinafter only referred to as "bulb") 1 has a glass bulb 2 and a base portion 3 made to be substantially flat by pinch sealing to thereby block the inside of the glass bulb 2. Filaments 4, 4 and two pairs of leads 5, 5 bridged by the filaments 4, 4 respectively, are disposed inside the glass bulb 2. End portions of the leads 5, 5 are led out from the base portion 3 to the outside, distributed to opposite sides 6, 7 of the base portion 3, and bent along the opposite sides 6, 7 of the base portion 3 to form feeding terminals 8, 8.

In addition, a heat-resistant transparent and colored coating 10 (e.g., an orange colored coating) in the form of a thin film is applied onto the surface of the glass bulb 2 up to a border portion 9 between the glass bulb 2 and the base portion 3.

Restriction protrusions 11, 11 and lock protrusions 12, 12 are formed on the opposite sides 6, 7 of the base portion 3 for restricting the position of the bulb 1 and preventing the bulb 1 from being detached when the bulb 1 is attached to an exclusiv[0085] use socket (not shown). Two restriction protrusions 11, 11 and one lock protrusion 12 are formed on each of the opposite sides 6, 7, so as to be symmetrical about a center of the bulb.

The shape and dimension of wedge-base bulbs are standardized in accordance with settled standards. As for the bulb 1, however, in order to distinguish the bulb 1 from conventional ones to prevent erroneous installation, the shape of the base portion 3 is changed, that is, the size and position of the restriction protrusions 11, 11 and the lock protrusions 12, 12 are changed, and therefore the position of the feeding terminals 8, 8 is also changed.

Figure 1:
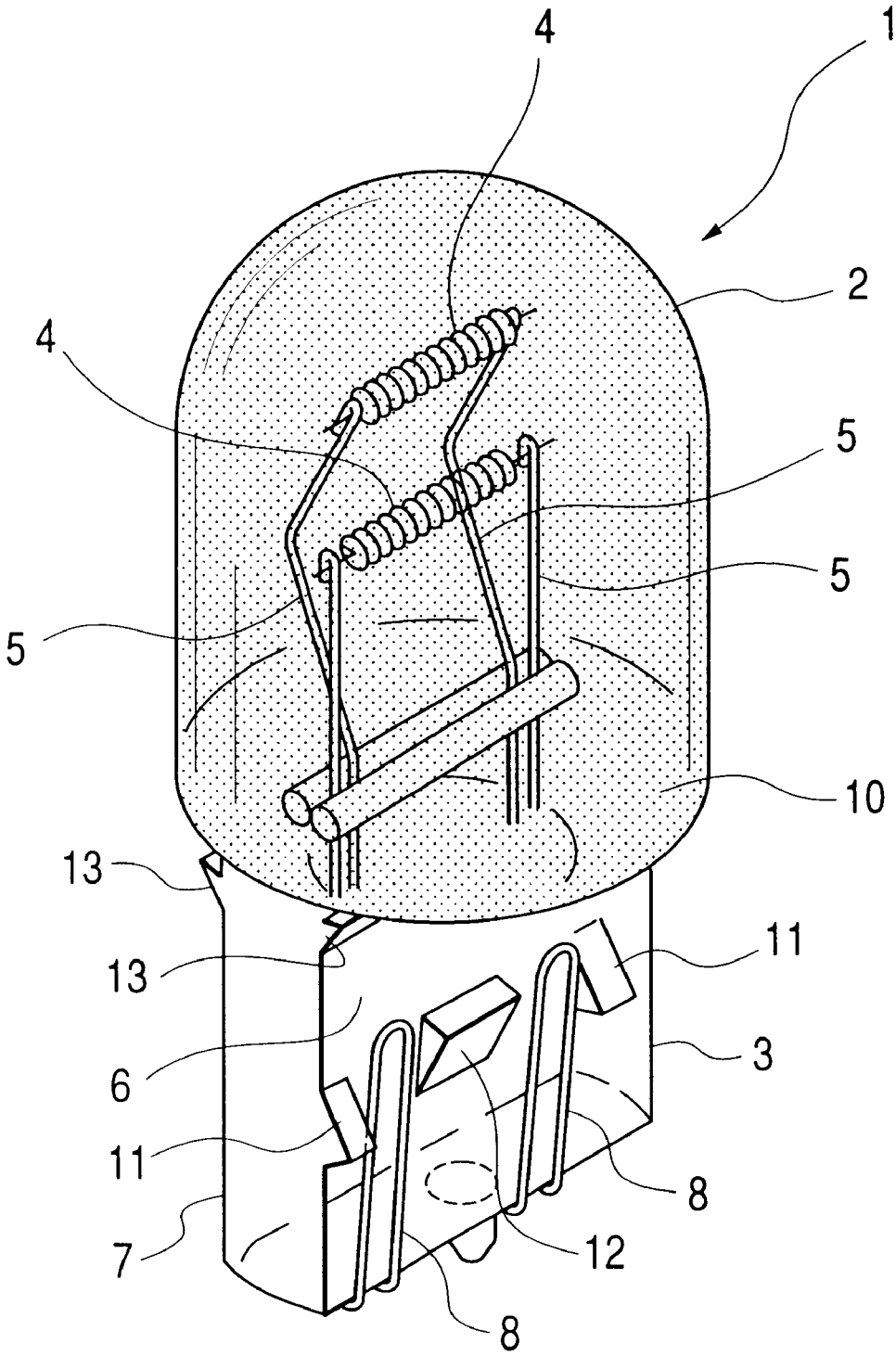
FIG. 1 is a perspective view showing, together with FIGS. 2 to 4, an embodiment of a wedge-base bulb according to the present invention.
Figure 2:
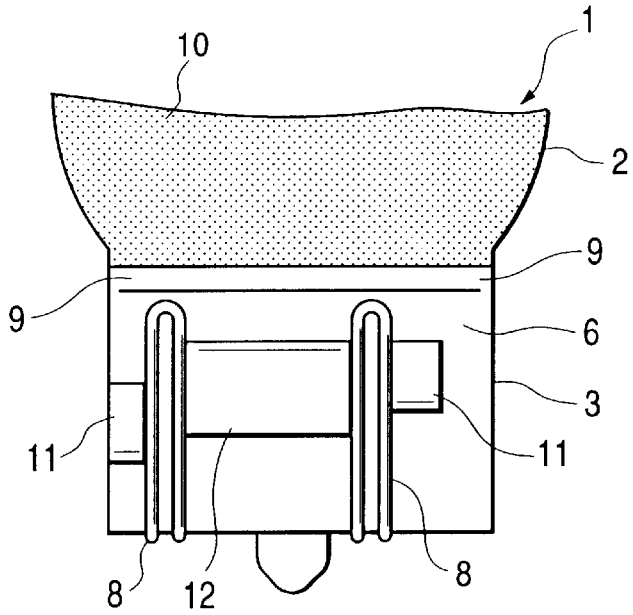
FIG. 2 is a front view of a base portion of the bulb.
Figure 3:
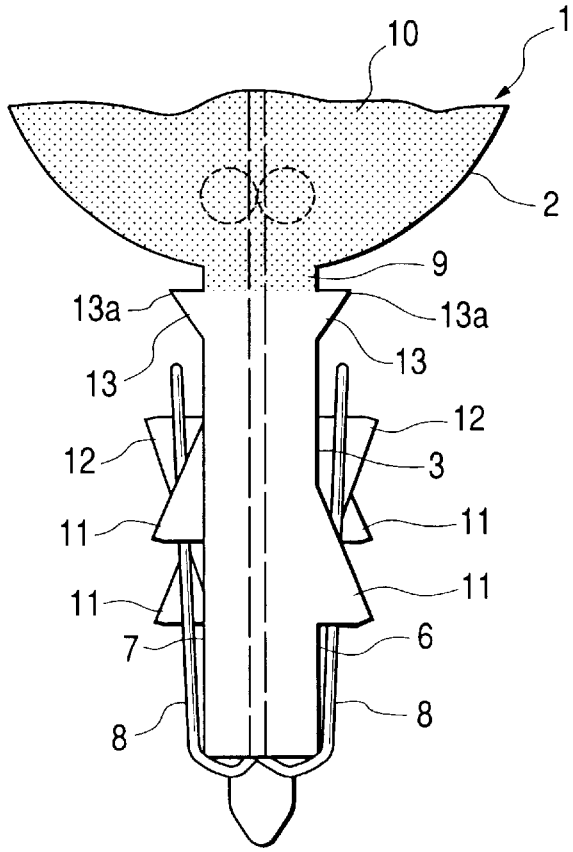
FIG. 3 is a side view of the base portion of the bulb.

In addition, on the border portion 9 between the glass bulb 2 and the base portion 3, ribs 13, 13 are integrally formed so as to extend straight from one end to the other end of the opposite sides 6, 7, respectively, along the border portion 9, as shown in FIG. 2. As for the shape of the ribs 13, 13, top end portions 13*a*, 13*a* are formed at an acute angle (about 45 degrees in this embodiment) when viewed from one end as shown in FIG. 3.

As mentioned above, the coating 10 is applied to the surface of the glass bulb 2. Therefore, a coating step for applying the coating 10 onto the surface of the glass bulb 2 is added to an ordinary process of manufacturing the bulb 1. In this coating step, as shown schematically in FIG. 4(*a*), only the glass bulb 2 of the bulb 1 is immersed in a liquid tank 15 containing a coating material 14 therein, and then, the bulb 1 is held in an obliquely inclined state with the glass bulb 2 disposed upside down, as shown in FIG. 4(*b*).

The excessive coating material 14 adhering to the glass bulb 2 flows down and drips off the bulb. At this time, because of presence of the ribs 13, 13 in the border portion 9 between the glass bulb 2 and the s base portion 3 of the bulb 1 as mentioned above, the excessive coating material 14 flows down along these ribs 13, 13, so that the ribs 13, 13 prevent the coating material 14 from flowing down to the base portion 3.

In practice, the excessive coating material flowing down along the ribs 13, 13 is: removed in a suitable manner (not shown), for example, such as by suction.

Some modifications to the above described method may be considered as follows.

For example, as shown in FIGS. 5 and 6, grooves 20, 20 are formed so as to be recessed inwardly from the surfaces of the opposite sides 6, 7 of the base portion 3, and so as to extend straight from one end to the other end of the opposite sides 6, 7, respectively, along the border portion 9 between the glass bulb 2 and the base portion 3. Alternatively, as shown in FIGS. 7 and 8, grooves 30, 30 and ribs 31, 31 are formed, sequentially, in that order from the glass bulb 2 to the base portion 3, so as to extend straight in parallel from one end to the other end in the opposite sides 6, 7, respectively, along the border portion 9 between the glass bulb 2 and the base portion 3.

Similar effects to that obtained by the ribs 13, 13 can be obtained by the grooves 20, 20 or the grooves 30, 30 and the ribs 31, 31, as will be described below. Particularly in the case where the groove 30, 30 and the ribs 31, 31 are provided, it is possible to obtain a very advantageous effect.

In addition, ribs 40, 40 can be formed so as to extend not along the border portion 9 between the glass bulb 2 and the base portion 3, but obliquely with a suitable angle with respect to the border portion 9, as shown in FIG. 9. When the ribs 40, 40 are formed so as to extend obliquely with a suitable angle with respect to the border portion 9, there is an effect by which the excessive coating material 14 flows down more easily along the ribs 40, 40 in the coating step shown in FIG. 4, in the case where the bulb 1 is held in an obliquely inclined state with the glass bulb 2 upside down.

As has been described above, by forming the ribs 13, 13, the grooves 20, 20, the grooves 30, 30 and the ribs 31, 31 or the ribs 40, 40 in the boundary portion 9 between the glass bulb 2 and the base portion 3 in the bulb 1, it is possible to effectively prevent the s excessive coating material 14 from adhering to the base portion 3 while it flows down along the ribs 13, 13, along the grooves 20, 20, along the grooves 30, 30 and the ribs 31, 31, or along the ribs 40, 40, in the coating step. It is therefore possible to prevent electric contact failure caused by the coating material 14 flowing down to the base portion 3 and adhering to the feeding terminals 8, 8. Further, by the provision of the ribs 13, 13, the grooves 20, 20, the grooves 30, 30 and the ribs 31, 31, or the ribs 40, 40, it is possible to apply the coating 10 to the entire surface of the glass bulb 2, through which light of the filaments 4, 4 is emitted, without taking the adhesion of the coating material 14 to the base portion 3 into consideration. Accordingly, all of the light that is emitted from the bulb is colored as desired.

As is apparent from the above description, a colored coating is formed on the surface of a glass bulb in a wedge-base bulb according to the present invention. Accordingly, it is not necessary to use a colored cap or a colored front lens in order to color the light emitted from the bulb. In addition, in the case of a so-called rear combination lamp, it is possible to make the lens have only one color. For example, the lens can be clear (transparent) in its entirety. Since the front lens does not need to be formed with multiple colors, the manufacturing cost is significantly reduced.

In addition, since a rib or a groove is formed in border portion between the glass portion and the base portion, it is possible to prevent a coating material from flowing down to the base portion and adhering to the base portion when a coating is applied onto the glass bulb.

Further, since the rib or the groove is formed in the surface of the base portion in which current-conducting terminals are disposed, it is possible to prevent the coating material for coating the glass bulb from adhering to the terminals to thereby prevent contact failure of the terminals from occurring. At the same time, because it is not necessary to take the adhesion of the coating material to the base portion into consideration, it is possible to apply a coating onto the entire surface of the glass bulb with ease. Accordingly, it is possible to prevent colorless and/or white light from being emitted to the outside.

The specific shapes and structures of the wedge-base bulb in the above-mentioned embodiments are only examples of the present invention. It should be understood that the technical scope of the present invention is not limited to these examples.

What is claimed is:

1. A wedge-base bulb , comprising:

a glass bulb and a base portion;

a filament disposed inside said bulb;

a lead supporting said filament inside said glass bulb. said lead extending outside said glass bulb through said base portion to form a terminal; and a colored coating formed on a surface of said bulb;

wherein said glass bulb and said base portion are separated by a border portion, and further comprising a rib formed at said border portion.

2. A wedge-base bulb as recited in claim 1, wherein said rib has a triangular cross sectional shape.

3. A wedge-base bulb as recited in claim 2, wherein two sides of said rib form an acute angle therebetween.

4. A wedge-base bulb as recited in claim 1, wherein said rib extends from one end of one side of said base portion to an opposite end of said one side of said base portion.

5. A wedge-base bulb as recited in claim 1, further comprising a groove formed at said border portion.

6. A wedge-base bulb as recited in claim 5, wherein said groove and said rib are formed sequentially in that order from said bulb to said base portion.

7. A wedge-base bulb as recited in claim 6, wherein said groove and said rib extend in parallel with each other.

8. A wedge-base bulb as recited in claim 1, wherein said glass bulb and said base portion are separated by a border portion, and further comprising a rib which extends at an oblique angle with respect to said border portion.

9. A wedge-base bulb as recited in claim 8, wherein said rib extends from one end of one side of said base portion to an opposite end of said one side of said base portion.

10. A wedge-base bulb comprising:

a glass bulb and a base portion;

a filament disposed inside said bulb;

a lead supporting said filament inside said glass bulb, said lead extending outside said glass bulb through said base portion to form a terminal; and a colored coating formed on a surface of said bulb;

wherein said glass bulb and said base portion are separated by a border portion, and further comprising a groove formed at said border portion.

11. A wedge-base bulb as recited in claim 10, wherein said groove is recessed from a surface of said base portion.

12. A wedge-base bulb as recited in claim 10, wherein said groove extends from one end of one side of said base portion to an opposite end of said one side of said base portion.

* * * * *